US006138877A

United States Patent [19]

Goff

[11] Patent Number: 6,138,877

[45] Date of Patent: Oct. 31, 2000

[54] SPOUT ATTACHMENT

[76] Inventor: Julian W. Goff, 5817 Citrus Blvd. Suite O, Harahan, La. 70123

[21] Appl. No.: 09/176,840

[22] Filed: Oct. 22, 1998

[51] Int. Cl.[7] ..... B67D 3/00

[52] U.S. Cl. ..... 222/479

[58] Field of Search ..... 222/464.1, 464.7, 222/547, 568, 382, 211, 189.1, 478, 479

[56] References Cited

U.S. PATENT DOCUMENTS

| | | | |
|---|---|---|---|
| 2,785,839 | 3/1957 | Pree | 222/479 |
| 2,812,113 | 11/1957 | Beall, Jr. | 222/479 |
| 2,951,619 | 9/1960 | Strumor | 222/478 |
| 5,104,010 | 4/1992 | Codorniz et al. | 222/479 X |
| 5,199,613 | 4/1993 | Magrath et al. | 222/478 X |
| 5,377,882 | 1/1995 | Pham et al. | 222/479 |
| 5,791,529 | 8/1998 | Mukai | 222/479 X |

FOREIGN PATENT DOCUMENTS

| | | | |
|---|---|---|---|
| 1349530 | 4/1974 | United Kingdom | 222/478 |

*Primary Examiner*—Kevin Shaver
*Assistant Examiner*—Thach Bui

[57] ABSTRACT

A spout attachment for attachment to the mouth of a bottle for aiding the smooth flow of fluid from the bottle. The spout attachment includes a tube designed for inserting into a bottle such that a bottom end of the tube is extended into the bottle and a top end of the tube is positioned adjacent a mouth of the bottle. A generally cylindrical mounting sleeve is provided having open upper and lower ends, and spaced apart inner and outer walls extending between the upper and lower ends of the mounting sleeve. The inner and outer walls 28,29 of the mounting sleeve define an annular channel therebetween opening at the lower end of the mounting sleeve. The annular channel is designed for receiving a neck of a bottle therein such that the inner wall of the mounting sleeve is inserted into the mouth of the bottle and the outer wall of the mounting sleeve is disposed around the neck of the bottle.

6 Claims, 2 Drawing Sheets

16
25
11
26

33
34
35
36
16
26
30
25
28
32
29
31

14
27
12
11
15

SPOUT ATTACHMENT

BACKGROUND OF THE INVENTION

1. Field of the Invention

The present invention relates to spout attachments for bottles and more particularly pertains to a new spout attachment for attachment to the mouth of a bottle for aiding the smooth flow of fluid from the bottle.

2. Description of the Prior Art

The use of spout attachments for bottles is known in the prior art. More specifically, spout attachments for bottles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,346,106; U.S. Pat. No. 5,449,098; U.S. Pat. No. 4,967,922; U.S. Pat. No. 5,232,110; U.S. Pat. No. 5,746,358; U.S. Pat. No. 4,838,464; U.S. Pat. No. 5,340,000; U.S. Pat. No. 4,892,230; U.S. Pat. No. 4,804,119; U.S. Pat. No. 4,412,633; and U.S. Pat. No. Des. 288,783.

While these devices fulfill their respective, particular objectives and requirements, the aforementioned patents do not disclose a new spout attachment. The inventive device includes a tube designed for inserting into a bottle such that a bottom end of the tube is extended into the bottle and a top end of the tube is positioned adjacent a mouth of the bottle. A generally cylindrical mounting sleeve is provided having open upper and lower ends, and spaced apart inner and outer walls extending between the upper and lower ends of the mounting sleeve. The inner and outer walls 28,29 of the mounting sleeve define an annular channel therebetween opening at the lower end of the mounting sleeve. The annular channel is designed for receiving a neck of a bottle therein such that the inner wall of the mounting sleeve is inserted into the mouth of the bottle and the outer wall of the mounting sleeve is disposed around the neck of the bottle.

In these respects, the spout attachment according to the present invention substantially departs from the conventional concepts and designs of the prior art, and in so doing provides an apparatus primarily developed for the purpose of attachment to the mouth of a bottle for aiding the smooth flow of fluid from the bottle.

SUMMARY OF THE INVENTION

In view of the foregoing disadvantages inherent in the known types of spout attachments for bottles now present in the prior art, the present invention provides a new spout attachment construction wherein the same can be utilized for attachment to the mouth of a bottle for aiding the smooth flow of fluid from the bottle.

The general purpose of the present invention, which will be described subsequently in greater detail, is to provide a new spout attachment apparatus and method which has many of the advantages of the spout attachments for bottles mentioned heretofore and many novel features that result in a new spout attachment which is not anticipated, rendered obvious, suggested, or even implied by any of the prior art spout attachments for bottles, either alone or in any combination thereof.

To attain this, the present invention generally comprises a tube designed for inserting into a bottle such that a bottom end of the tube is extended into the bottle and a top end of the tube is positioned adjacent a mouth of the bottle. A generally cylindrical mounting sleeve is provided having open upper and lower ends, and spaced apart inner and outer walls extending between the upper and lower ends of the mounting sleeve. The inner and outer walls 28,29 of the mounting sleeve define an annular channel therebetween opening at the lower end of the mounting sleeve. The annular channel is designed for receiving a neck of a bottle therein such that the inner wall of the mounting sleeve is inserted into the mouth of the bottle and the outer wall of the mounting sleeve is disposed around the neck of the bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spout attachment apparatus and method which has many of the advantages of the spout attachments for bottles mentioned heretofore and many novel features that result in a new spout attachment which is not anticipated, rendered obvious, suggested, or even implied by any of the prior art spout attachments for bottles, either alone or in any combination thereof.

It is another object of the present invention to provide a new spout attachment which may be easily and efficiently manufactured and marketed.

It is a further object of the present invention to provide a new spout attachment which is of a durable and reliable construction.

An even further object of the present invention is to provide a new spout attachment which is susceptible of a low cost of manufacture with regard to both materials and labor, and which accordingly is then susceptible of low prices of sale to the consuming public, thereby making such spout attachment economically available to the buying public.

Still yet another object of the present invention is to provide a new spout attachment which provides in the apparatuses and methods of the prior art some of the advantages thereof, while simultaneously overcoming some of the disadvantages normally associated therewith.

Still another object of the present invention is to provide a new spout attachment for attachment to the mouth of a bottle for aiding the smooth flow of fluid from the bottle.

Yet another object of the present invention is to provide a new spout attachment which includes a tube designed for inserting into a bottle such that a bottom end of the tube is extended into the bottle and a top end of the tube is positioned adjacent a mouth of the bottle. A generally cylindrical mounting sleeve is provided having open upper and lower ends, and spaced apart inner and outer walls extending between the upper and lower ends of the mounting sleeve. The inner and outer walls 28,29 of the mounting sleeve define an annular channel therebetween opening at the lower end of the mounting sleeve. The annular channel is designed for receiving a neck of a bottle therein such that the inner wall of the mounting sleeve is inserted into the mouth of the bottle and the outer wall of the mounting sleeve is disposed around the neck of the bottle.

Still yet another object of the present invention is to provide a new spout attachment that helps keep carbonated beverages bubbly (and thus extending the "life" of a stored carbonated beverage before it becomes flat) by helping to reduce agitation to the beverage when some of the beverage is poured out of the bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
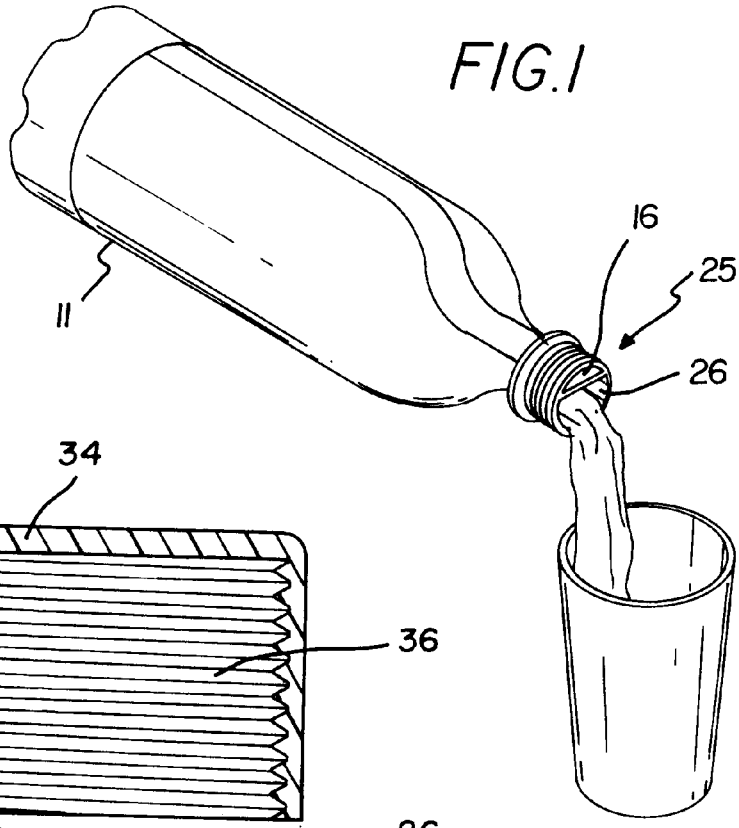
FIG. 1 is a schematic perspective view of a new spout attachment in use with a bottle pouring fluid out of the bottle according to the present invention.

With reference now to the drawings, and in particular to FIGS. 1 through 4 thereof, a new spout attachment embodying the principles and concepts of the present invention and generally designated by the reference numeral 10 will be described.

As best illustrated in FIGS. 1 through 4, the spout attachment 10 generally comprises a tube 15 designed for inserting into a bottle 11 such that a bottom end 17 of the tube 15 is extended into the bottle 11 and a top end 16 of the tube 15 is positioned adjacent a mouth 13 of the bottle 11. A generally cylindrical mounting sleeve 25 is provided having open upper and lower ends 26,27, and spaced apart inner and outer walls 28,29 extending between the upper and lower ends 26,27 of the mounting sleeve 25. The inner and outer walls 28,29 of the mounting sleeve 25 define an annular channel therebetween opening at the lower end 27 of the mounting sleeve 25. The annular channel is designed for receiving a neck 12 of a bottle 11 therein such that the inner wall 28 of the mounting sleeve 25 is inserted into the mouth 13 of the bottle 11 and the outer wall 29 of the mounting sleeve 25 is disposed around the neck 12 of the bottle 11.

In closer detail, the spout attachment 10 is designed for use in combination with a bottle 11 (especially a carbonated beverage bottle such as a 2 liter or 3 liter soft drink bottle) having a threaded neck 12 terminating at a mouth 13. Specifically, the spout attachment comprises a tube 15 having a lumen and open top and bottom ends 16,17 providing openings into the lumen of the tube 15. In use, the tube 15 is designed for inserting into a bottle 11 such that the bottom end 17 of the tube 15 is extended into the bottle 11 and the top end 16 of the tube 15 is positioned adjacent a mouth 13 of the bottle 11. The tube 15 provides a conduit during the pouring of fluid out of the bottle 11 for letting air pass into the bottle 11 from the top end 16 of the tube 15 to the bottom of the bottle 11 when the bottom end 17 of the tube 15 is positioned to prevent violet pouring of fluid out of the mouth 13 of the bottle 11.

The tube 15 has a pair of arcuate bends 18,19 forming a generally S-shaped region located between the top and bottom ends 16,17 of the tube 15. The bends 18,19 of the tube 15 define elongate top and bottom portions 20,21 of the tube 15. The top portion 20 of the tube 15 is positioned adjacent the top end 16 of the tube 15. The bottom portion 21 of the tube 15 is positioned adjacent the bottom end 17 of the tube 15. The top and bottom portions 20,21 of the tube 15 each have a longitudinal axis extending from the adjacent end of the tube and an adjacent bend of the tube. Preferably, the longitudinal axes of the top and bottom portions 20,21 of the tube 15 are extended substantially parallel to one another.

The bends 18,19 of the tube 15 also defining an arcuate middle portion 22 of the tube 15 therebetween. The middle portion 22 of the tube 15 generally lies in a plane extended at an obtuse angle to the longitudinal axes of the top and bottom portions 20,21 of the tube 15. Preferably, the obtuse angle of the middle portion 22 is between about 120 degrees and about 170 degrees. Ideally, the obtuse angle is about 150 degrees. In use, the bends 18,19 of the tube 15 are designed for positioning the bottom portion 21 of the tube 15 adjacent a side of the bottle 11 with longitudinal axis of the top portion 20 of the tube 15 is generally coaxial with the mouth 13 and neck 12 of the bottle 11.

The top and bottom portions each has a length defined along the respective longitudinal axis. Preferably, the length of the bottom portion is greater than the length of the top portion 20. Ideally, the length of the top portion 20 is greater than at least two inches to help insure that the middle portion 22 of the tube 15 is far enough down in a traditional 2 liter soft drink bottle 11 so that the bottom portion 21 of the tube 15 may be positioned against the side of the bottle 11.

Figure 4:
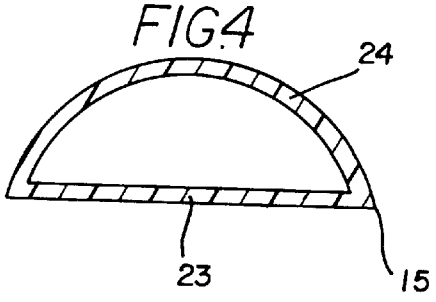
FIG. 4 is a schematic transverse cross sectional view of the tube of the present invention.

As illustrated in FIG. 4, preferably, the tube 15 has a generally D-shaped transverse cross section such that the tube 15 has a generally planar side 23 and an arcuate side 24 and such that the lumen of the tube 15 also has a generally D-shaped transverse cross section.

Figure 2:
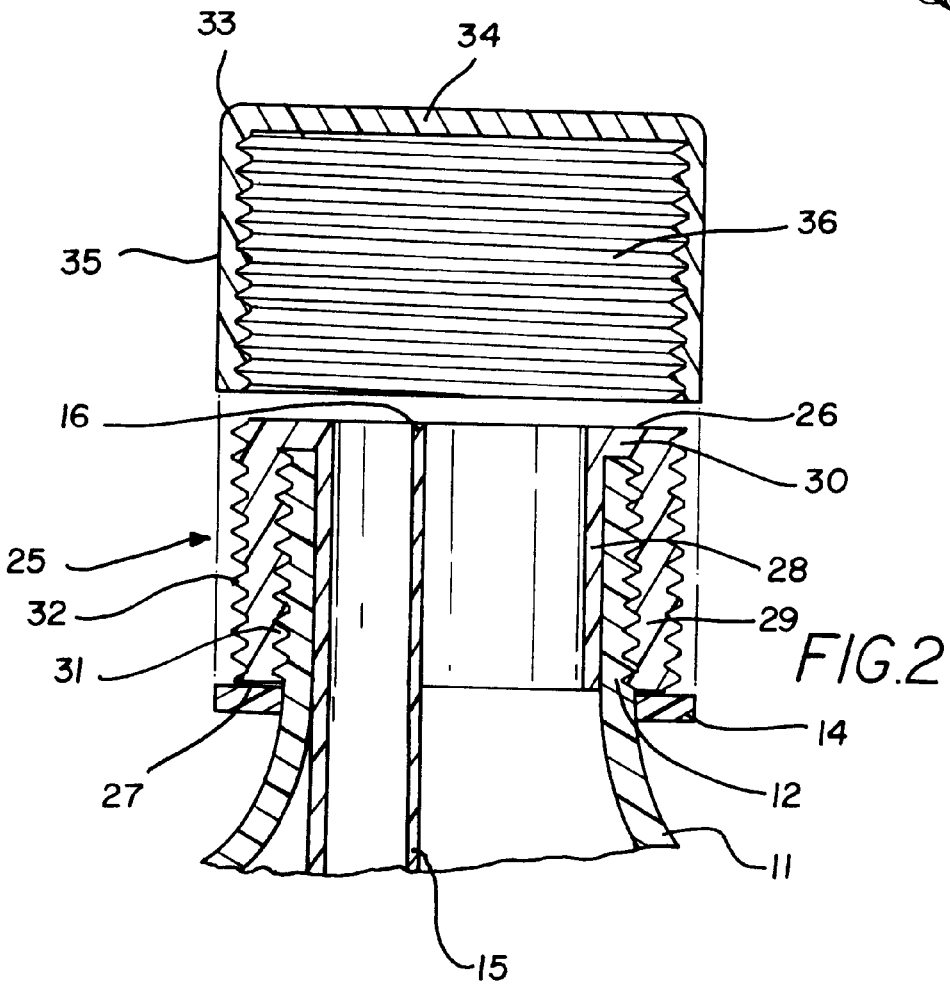
FIG. 2 is a schematic exploded cross sectional view of the area around the mounting sleeve of the present invention when attached to the neck of a bottle.

The generally cylindrical mounting sleeve 25 has generally circular open upper and lower ends 26,27, and spaced apart generally cylindrical inner and outer walls 28,29 extending between the upper and lower ends 26,27 of the mounting sleeve 25. The inner and outer walls 28,29 of the mounting sleeve 25 are connected together at the upper end 26 of the mounting sleeve 25 by an integral annular ring portion 30 extending therebetween. The inner and outer walls 28,29 of the mounting sleeve 25 define an annular channel therebetween opening at the lower end 27 of the mounting sleeve 25. In use, as illustrated in FIG. 2, the annular channel is designed for receiving a neck 12 of a bottle 11 therein such that the inner wall 28 of the mounting sleeve 25 is inserted into the mouth 13 of the bottle 11 and the outer wall 29 of the mounting sleeve 25 is disposed around the neck 12 of the bottle 11. Ideally, lower end 27 of the mounting sleeve 25 also abuts against an outwardly radiating annular lip 14 around the neck 12 of the bottle 11.

The outer wall 29 of the mounting sleeve 25 has threaded interior and exterior surfaces 31,32. The threaded interior surface 31 of the outer wall 29 faces into the annular channel of the mounting sleeve 25. In use, the threaded interior surface 31 of the outer wall 29 is designed for threaded attachment to a threaded neck 12 of a bottle 11 inserted into the annular channel of the mounting sleeve 25 as shown in FIG. 2.

The inner wall 28 of the mounting sleeve 25 defines a generally cylindrical passage through the mounting sleeve 25 between the upper and lower ends 26,27 of the mounting sleeve 25. The top end 16 of the tube 15 is extended into the passage of the mounting sleeve 25 through the lower end 27 of the mounting sleeve 25 such that the bottom end 17 of the tube 15 outwardly extends from the lower end 27 of the mounting sleeve 25. The arcuate side 24 of the tube 15 is coupled to the inner wall 28 of the mounting sleeve 25. Preferably, the top end 16 of the tube 15 and the upper end 26 of the mounting sleeve 25 generally lie in a common plane with one another such that the top end 16 of the tube 15 is flush with the upper end 26 of the mounting sleeve 25.

The inner wall 28 of the mounting sleeve 25 has a generally circular transverse cross section lie in a plane generally parallel to the planes in which the upper and lower ends 26,27 of the mounting sleeve 25 lie in. The transverse cross section of the inner wall 28 defines a boundary of a generally circular area. Preferably, the transverse cross section of the lumen of the tube 15 defines an area greater than about one-fourth of the area of bounded by the transverse cross section of the inner wall 28 of the mounting sleeve 25 for providing sufficiently large enough to air pass through the lumen of the tube 15 and not be blocked by any bubbles from carbonated fluid that may be in the lumen of the tube 15. Also preferably, the transverse cross section of the lumen of the tube 15 defining an area of less than about one-half of the area of bounded by the transverse cross section of the inner wall 28 of the mounting sleeve 25 so that the tube 15 does not block too much of the passage through the mounting sleeve 25. Ideally, the transverse cross section of the lumen of the tube 15 defining an area of about one-third of the area of bounded by the transverse cross section of the inner wall 28 of the mounting sleeve 25 to help optimally ensure that the air passing through the tube 15 is not blocked by carbonation bubbles of any carbonated fluid in the tube 15.

Figure 3:
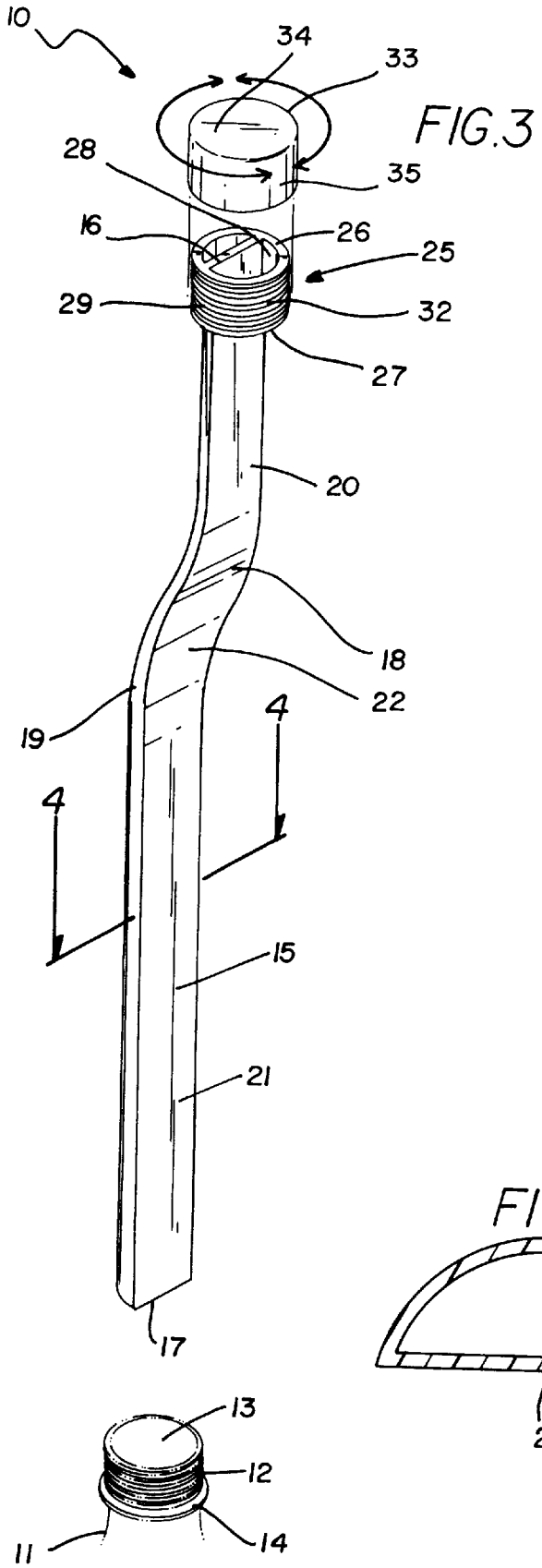
FIG. 3 is a schematic perspective view of the present invention.

As illustrated in FIGS. 2 and 3, preferably a cap 33 substantially closes the upper end 26 of the mounting sleeve 25 and the top end 16 of the tube 15. The cap 33 has a generally circular upper portion 34 and a generally cylindrical perimeter side 35 downwardly extending around the upper portion 34 of the cap 33. The perimeter side 35 of the cap 33 has a threaded interior portion 36. The cap 33 receives the upper end 26 of the mounting sleeve 25 therein. The threaded interior portion 36 of the perimeter side 35 of the cap 33 is threaded onto the threaded outer surface of the outer wall 29 of the mounting sleeve 25 to threadably couple the cap 33 on the mounting sleeve 25 to provide an air tight closure of the mounting sleeve 25 and tube 15 on the bottle 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spout attachment for a bottle, said spout attachment comprising:

a tube having a lumen and open top and bottom ends;

said tube being adapted for inserting into a bottle such that said bottom end of said tube is extended into the bottle and said top end of said tube is positioned adjacent a mouth of the bottle;

a generally cylindrical mounting sleeve having open upper and lower ends, and spaced apart inner and outer walls extending between said upper and lower ends of said mounting sleeve;

said inner and outer walls of said mounting sleeve being connected together at said upper end of said mounting sleeve, said inner and outer walls of said mounting sleeve defining an annular channel therebetween opening at lower end of said mounting sleeve;

said annular channel being adapted for receiving a neck of a bottle therein such that said inner wall of said mounting sleeve is inserted into the mouth of the bottle and said outer wall of said mounting sleeve is disposed around the neck of the bottle;

wherein said tube has a pair of arcuate bends forming a generally S-shaped region located between said top and bottom ends of said tube, said bends of said tube defining elongate top and bottom portions of said tube, said top portion of sad tube being positioned adjacent said top end of said tube, said bottom portion of said tube being positioned adjacent said bottom end of said tube, said top and bottom portions of said tube each having a longitudinal axis; and wherein said tube extends beyond the lower end of said mounting sleeve such that said S-shaped region is located outside said mounting sleeve;

wherein said longitudinal axes of said top and bottom portions of said tube are extended substantially parallel to one another;

wherein said bends of said tube define an arcuate middle portion of said tube therebetween, said middle portion of said tube generally lying in a plane extended at an obtuse angle to said longitudinal axes of said top and bottom portions of said tube;

wherein said outer wall of said mounting sleeve has a threaded interior surface, said threaded interior surface of said outer wall facing into said annular channel of said mounting sleeve said threaded interior surface of said outer wall being adapted for threaded attachment to a threaded neck of a bottle inserted into said annular channel of said mounting sleeve;

wherein said tube has a generally D-shaped transverse cross section such that said tube has a generally planar side and an arcuate side and such that said lumen of said tube has a generally D-shaped transverse cross section, said arcuate side of said tube being coupled to said inner wall of said mounting sleeve;

wherein said inner wall of said mounting sleeve has a generally circular transverse cross section defining a boundary of a generally circular area, said transverse cross section of said lumen of said tube defining an area greater than about one-fourth of said area of bounded by said transverse cross section of said inner wall of said mounting sleeve;

further comprising a cap substantially closing said upper end of said mounting sleeve and said top end of said tube, said cap having a generally circular upper portion and a generally cylindrical perimeter side downwardly extending around said upper portion of said cap, said perimeter side of said cap having a threaded interior portion, wherein said outer wall of said mounting sleeve has a threaded outer surface, said cap receiving said upper end of said mounting sleeve therein, said threaded interior portion of said perimeter side of said cap being threaded onto said threaded outer surface of said outer wall of said mounting sleeve to threadably couple said cap on said mounting sleeve;

wherein said top and bottom portions each have a length defined along the respective longitudinal axis, wherein said length of said bottom portion is greater than said length of said top portion;

wherein said length of said top portion is greater than at least two inches to facilitate insertion of said middle portion of said tube beyond a tapered portion of the bottle;

wherein a length of said bottom portion is greater than a length of said top portion and a length of said S-shaped region combined for facilitating positioning of said bottom portion of said tube against the side of the bottle.

2. The spout attachment of claim 1, wherein said obtuse angle of said middle portion is between about 120 degrees and about 170 degrees.

3. The spout attachment of claim 1, wherein said obtuse angle is about 150 degrees.

4. The spout attachment of claim 3, wherein said transverse cross section of said lumen of said tube defines an area of less than about one-half of said area of bounded by said transverse cross section of said inner wall of said mounting sleeve.

5. The spout attachment of claim 4, wherein said transverse cross section of said lumen of said tube defines an area of about one-third of said area of bounded by said transverse cross section of said inner wall of said mounting sleeve.

6. A spout attachment for a bottle having a threaded neck terminating at a mouth, said spout attachment comprising:

a tube having a lumen and open top and bottom ends providing openings into said lumen of said tube;

said tube being adapted for inserting into a bottle such that said bottom end of said tube is extended into the bottle and said top end of said tube is positioned adjacent a mouth of the bottle, said tube being for providing a conduit during pouring of fluid out of the bottle for letting air pass into the bottle from said top end of said tube to the bottom of the bottle when said bottom end of said tube is positioned to prevent violent pouring of fluid out of the mouth of the bottle;

said tube having a pair of arcuate bends forming a generally S-shaped region located between said top and bottom ends of said tube;

said bends of said tube defining elongate top and bottom portions of said tube, said top portion of sad tube being positioned adjacent said top end of said tube, said bottom portion of said tube being positioned adjacent said bottom end of said tube, said top and bottom portions of said tube each having a longitudinal axis extending from said adjacent end of said tube and an adjacent bend of said tube, said longitudinal axes of said top and bottom portions of said tube being extended substantially parallel to one another;

said bends of said tube defining an arcuate middle portion of said tube therebetween, said middle portion of said tube generally lying in a plane extended at an obtuse angle to said longitudinal axes of said top and bottom portions of said tube;

wherein said obtuse angle is about 150 degrees;

said bends of said tube being for positioning said bottom portion of said tube adjacent a side of the bottle with longitudinal axis of the top portion of said tube being generally coaxial with the mouth of the bottle;

said top and bottom portions each having a length defined along the respective longitudinal axis, wherein said length of said bottom portion is greater than said length of said top portion, wherein said length of said top portion is greater than at least two inches to facilitate insertion of said middle portion of said tube beyond a tapered portion of the bottle so that said bottom portion of said tube may be positioned against the side of the bottle;

said tube having a generally D-shaped transverse cross section such that said tube has a generally planar side and an arcuate side and such that said lumen of said tube has a generally D-shaped transverse cross section;

a generally cylindrical mounting sleeve having generally circular open upper and lower ends, spaced apart generally cylindrical inner and outer walls extending between said upper and lower ends of said mounting sleeve;

said inner and outer walls of said mounting sleeve being connected together at said upper end of said mounting sleeve, said inner and outer walls of said mounting sleeve defining an annular channel therebetween opening at lower end of said mounting sleeve;

said annular channel being adapted for receiving a neck of a bottle therein such that said inner wall of said mounting sleeve is inserted into the mouth of the bottle and said outer wall of said mounting sleeve is disposed around the neck of the bottle such that said lower end of said mounting sleeve is abutting against an outwardly radiating annular lip around the neck of the bottle;

said outer wall of said mounting sleeve having threaded interior and exterior surfaces, said threaded interior surface of said outer wall facing into said annular channel of said mounting sleeve, said threaded interior surface of said outer wall being adapted for threaded attachment to a threaded neck of a bottle inserted into said annular channel of said mounting sleeve;

said inner wall of said mounting sleeve defining a passage through said mounting sleeve between said upper and lower ends of said mounting sleeve;

said top end of said tube being extended into said passage of said mounting sleeve through said lower end of said mounting sleeve such that said bottom end of said tube outwardly extends from said lower end of said mounting sleeve;

said arcuate side of said tube being coupled to said inner wall of said mounting sleeve;

said top end of said tube and said upper end of said mounting sleeve being generally lying in a common plane with one another such that the top end of the tube is flush with the upper end of the mounting sleeve;

said inner wall of said mounting sleeve having a generally circular transverse cross section lying in a plane generally parallel to said planes in which said upper and lower ends of said mounting sleeve lie in, said transverse cross section of said inner wall defining a boundary of a generally circular area;

said transverse cross section of said lumen of said tube defining an area of about one-third of said area of bounded by said transverse cross section of said inner wall of said mounting sleeve for providing sufficiently large enough to air pass through said lumen of said tube and not be blocked by any bubbles from carbonated fluid that may be in said lumen of said tube; and a cap substantially closing said upper end of said mounting sleeve and said top end of said tube, said cap having a generally circular upper portion and a generally cylindrical perimeter side downwardly extending around said upper portion of said cap, said perimeter side of said cap having a threaded interior portion, said cap receiving said upper end of said mounting sleeve therein, said threaded interior portion of said perimeter side of said cap being threaded onto said threaded outer surface of said outer wall of said mounting sleeve to threadably couple said cap on said mounting sleeve to provide an air tight closure of said mounting sleeve and tube on the bottle.

* * * * *